US006258738B1

(12) United States Patent
Charpentier

(10) Patent No.: US 6,258,738 B1
(45) Date of Patent: Jul. 10, 2001

(54) COATING WITH TEXTILE APPEARANCE FOR COVERING SHAPED PANELS

(75) Inventor: Franck Charpentier, Pessac (FR)

(73) Assignee: Texaa, Gradignan (FR)

( * ) Notice: Subject to any disclaimer, the term of this patent is extended or adjusted under 35 U.S.C. 154(b) by 0 days.

(21) Appl. No.: 09/355,181

(22) PCT Filed: Feb. 6, 1998

(86) PCT No.: PCT/FR98/00219

§ 371 Date: Jul. 27, 1999

§ 102(e) Date: Jul. 27, 1999

(87) PCT Pub. No.: WO98/35082

PCT Pub. Date: Aug. 13, 1998

(30) Foreign Application Priority Data

Feb. 7, 1997 (FR) ..... 97 01632

(51) Int. Cl.[7] ..... D04B 1/00; D04B 11/00; D04B 21/00; D04B 7/00; D04B 9/00

(52) U.S. Cl. ..... 442/304; 442/307; 442/312; 66/195; 66/203; 66/82 R

(58) Field of Search ..... 442/304, 307, 442/312; 66/195, 203, 82 R

(56) References Cited

U.S. PATENT DOCUMENTS

| | | | | |
|---|---|---|---|---|
| 3,624,179 | * | 11/1971 | Carroll | 260/830 ER |
| 4,026,130 | * | 5/1977 | Gajjar | 66/203 |
| 4,215,168 | | 7/1980 | Yonemura et al. . | |
| 4,277,527 | | 7/1981 | Duhl . | |
| 4,688,403 | * | 8/1987 | Gajjar | 66/195 |
| 5,638,703 | * | 6/1997 | Callaway | 66/195 |

FOREIGN PATENT DOCUMENTS

| | | |
|---|---|---|
| 484 309 | 1/1970 | (CH) . |
| 0 631 004 | 12/1994 | (EP) . |
| 1 092 385 | 1/1966 | (GB) . |

OTHER PUBLICATIONS

Derwent Abstract, Japanese Publication AN 86–085470.

* cited by examiner

*Primary Examiner*—Terrel Morris
*Assistant Examiner*—Norca L. Torres
(74) *Attorney, Agent, or Firm*—Wolf, Greenfield & Sacks, P.C.

(57) ABSTRACT

The covering of the invention for covering shaped panels is constituted by a knit (2) obtained on a four-bar Raschel or warp loom having two ground threads feeding the first guide needle (I) (Raschel notation) and two appearance threads feeding the second and third guide needles (II and III) in the following arrangement:

| I | II | II |
|---|---|---|
| x | x | x |
| 0 | x | x |
| — | — | — |
| x | x | x |
| x | 2x | 2x |
| — | — | — |
| x | x | x |
| 2x | x | x |
| — | — | — |
| x | x | x |
| x | 0 | 0 |
| — | — | — |

where x is preferably equal to 2; the outside face (2*a*) of the knit (2) has a transparent coating (3) of an anti-adhesive material, e.g. a highly deformable transparent and light-weight membrane (3) made of an anti-adhesive material.

6 Claims, No Drawings

COATING WITH TEXTILE APPEARANCE FOR COVERING SHAPED PANELS

The present invention relates to covering shaped panels, i.e. panels that are not necessarily plane and which require the covering used to cover them to be deformed, e.g. by implementing a technique of the hot-forming type. The invention relates more particularly to a covering of this type that presents a textile-like outer appearance and that is easy to clean.

The purpose of such covering is to use material of pleasing appearance to hide some element. For example, in an aircraft cabin, the walls of the cabin are lined with panels made of material that has the qualities that are necessary for absorbing sound, for example melamine-formol type foam. Such panels match the inside shape of the fuselage and they are therefore not plane. When covering is applied to a shaped panel, it is necessary for it to be possible to deform the said covering locally so as to cause it to fit closely over the outside configuration of the panel. It is therefore important for the covering material to be capable of lengthening sufficiently to be able to match the outside shapes of the panel. Naturally, the above remarks concerning panels for aircraft cabins apply equally well to any type of shaped panel.

It is also desirable that such coverings should be pleasing in appearance and easy to clean. From the appearance point of view, it is often desirable for the covering to have a textile-like appearance, which is sufficiently opaque to hide the covered panel and which imparts a warm and comfortable visual effect to the covering, as contrasted with a smooth plastics covering. Nevertheless, a textile-like appearance is generally incompatible with ease of cleaning insofar as the fibers or filaments constituting the textile covering can easily absorb dust, dirty marks, etc.

The object of the Applicant is to propose a covering material for covering shaped panels, that has a good textile-like appearance, and that is easy to clean.

This object is achieved by the covering material of the invention which, in characteristic manner, is constituted by a knit obtained on a four-bar Raschel or warp loom having two ground threads feeding the first guide needle (I) (Raschel notation) and two appearance threads feeding the second and third guide needles (II and III) in the following arrangement:

| I | II | II |
|---|---|---|
| x | x | x |
| 0 | x | x |
| — | — | — |
| x | x | x |
| x | 2x | 2x |
| — | — | — |
| x | x | x |
| 2x | x | x |
| — | — | — |
| x | x | x |
| x | 0 | 0 |
| — | — | — |

In addition, the outside face of the knit has a transparent coating of anti-adhesive material.

The particular structure of the knit gives it the desired textile-like appearance, opaqueness, and deformability; the coating in anti-adhesive material prevents stains being absorbed or becoming incrusted in the outside face of the knit; the transparent nature of the coating enables it to maintain its textile-like visual appearance.

Preferably, the value x in the arrangement of the Raschel or warp loom is two. The Applicant has observed that knitting in this way provides results of particularly high performance concerning deformability.

The knit obtained on the Raschel or warp loom preferably has a gauge of about 12. This thread density is suitable for giving the knit very good opaqueness, making it possible to mask as well as possible the panel on which the covering is applied.

In a first embodiment, the outside face of the knit is coated in a lightweight membrane that is transparent and highly deformable, and that is made out of an anti-adhesive material. The deformability of the membrane must be at least equivalent to that of the knit so that there is no damage to the covering while it is being applied to the shaped panels that are to be covered. The membrane must be lightweight so as to avoid excessively increasing the weight of the covering and so as to avoid changing its visual appearance and possibly also its feel.

Preferably, the membrane in question is a polyurethane-based membrane which is applied by transfer and is stuck to the surface of the knit by an adhesive that is likewise based on polyurethane.

This type of membrane gives the covering its easy-maintenance qualities insofar as the knit itself is no longer bare but is protected by the membrane which is firstly is difficult to stain and secondly is easy to clean using ordinary cleaning fluids.

In a second variant embodiment, each thread constituting the knit is sheathed in a transparent outer coating of anti-adhesive material. In this second variant, it is the sheathing on each thread constituting the covering that protects the outside face of the knit.

Compared with the first variant, sheathing in this way provides both drawbacks and advantages. To obtain an effect that is equivalent to having an outer membrane, it is necessary for the sheath on each thread to be sufficiently strong, thereby giving rise to a much larger overall increase in the weight of the covering material. Nor is there a total barrier preventing dirt from penetrating into the knit, so dirt can become incrusted between the stitches of the knit, from which it is difficult to clean. Nevertheless, this variant embodiment presents a significant advantage over a membrane when it is desired for the covering to be acoustically transparent (as opposed to acoustically reflecting) in order to avoid decreasing the sound-absorbing efficiency of the shaped panel it covers. This is particularly true when covering sound-absorbing walls, particularly in an aircraft cabin. It is true that a polyurethane membrane, described above as being the preferred embodiment of the invention, also possesses a certain amount of acoustic transparency because of its micropores; nevertheless, the presence of such a membrane still constitutes a factor that diminishes the effectiveness with which the sound-absorbing panel including the membrane in its covering actually absorbs sound.

The present invention will be better understood on reading the following description of a preferred embodiment of a covering for covering shaped panels, the covering comprising a Raschel or warp knit, itself coated on its outside face with a transparent and lightweight membrane of polyurethane.

The covering of the invention is intended for use in covering any shaped panel, i.e. any panel whose outside surface is not necessarily plane, with the covering being applied to the panel in particular by using a forming type technique, in which the covering is hot-formed so as to cause it to take up the outside shape of the panel that is to be covered. Amongst the applications intended by the Applicant, there are in particular covering sound-absorbing panels, of the kind that line the inside of aircraft cabins. Naturally, this application is not exclusive.

The Applicant has sought to combine in a single covering both a very high degree of deformability, capable of amounting to as much as 100% in the weft direction and 85% in the warp direction, and a manifestly textile-like appearance with a high degree of opaqueness and with relief that is apparent, and associated with being very easy to clean. In a preferred first embodiment, the covering proposed by the Applicant comprises a knit obtained on a Raschel or warp loom and a membrane which is placed on the outside face of the knit and which is made of a material that is anti-adhesive and transparent.

More precisely, the knit is obtained on a four-bar loom with two ground threads feeding the first guide needle (I) (Raschel notation), and two appearance threads feeding the second and third guide needles (II and III) in the following arrangement:

| I | II | II |
|---|---|---|
| x | x | x |
| 0 | x | x |
| — | — | — |
| x | x | x |
| x | 2x | 2x |
| — | — | — |
| x | x | x |
| 2x | x | x |
| — | — | — |
| x | x | x |
| x | 0 | 0 |
| — | — | — |

Such a knit, satisfying the above definition, has a textile-like outside appearance and is sufficiently opaque to mask defects in the surface of the panel that is to be covered; in addition, it presents good deformability. Finally, where necessary, it presents good acoustic transparency, particularly if it is to be applied as a covering in an aircraft cabin.

It should be observed that the knit is obtained on a four-bar loom having only three of its bars fed, while both ground threads are fed together to the same first guide needle. It is the presence of these two threads on the same guide needle that gives the knit its particular appearance of relief. Naturally, because of the presence of two threads on the same guide needle, the needles of the Raschel or warp loom must be fitted with hooks that are larger than those of a conventional loom.

To obtain a knit having this structure and that is also balanced, the Applicant finds that it is appropriate to ensure that a certain value is complied with for absorbed thread length, referred to below as ATL, as a function of the weight of the threads constituting the knit. Table 1 below gives the minimum and maximum ATL values for a given thread weight, it being understood that the weight concerned is the resulting weight for two-ended threads.

| Weight (dtex) | Minimum ATL in cm/100 stitches | Maximum ATL in cm/100 stitches |
|---|---|---|
| 667 | 28 | 37 |
| 50 | 27 | 35 |
| 400 | 22 | 32 |

When the covering is also required to satisfy standards concerning fire regulations, the threads used are based on polyvinyl chloride fibers obtained either by the short fiber or "cotton" spinning technique or by the long fiber or "wool" spinning technique. In a particular example, in the first case, the fibers used were cut to 6 cm and weighed 2.8 dtex, with twist lying in the range 500 turns per meter (t/m) to 570 t/m. In the second case, the fibers used were cut to lengths lying in the range 70 mm to 110 mm, and weighed 3.9 dtex for twist lying in the range 380 t/m to 440 t/m.

The knit obtained with 500 dtex threads having an ATL of 32 cm per 100 stitches weighs about 250 g/m$^2$ to 400 g/m$^2$ as a function of its gauge. In a preferred embodiment, the gauge used is 12 and the value of the parameter x in the arrangement is 2.

The membrane placed against the outside face of the knit, i.e. the face which is not to be pressed against the shaped panel that is to be covered, is a membrane that is transparent, lightweight, and made of a non-adhesive material. Because the membrane is transparent, the covering retains its textile external appearance; because the membrane is lightweight, it does not excessively increase the weight of the covering, given that weight is an important factor, particularly when the covering is for use in an aircraft cabin; because of its composition, the membrane constitutes a screen against dirt, which does not adhere to its surface and as a result is easily cleaned off.

The membrane preferred by the Applicant is a membrane based on polyurethane, which is slightly microporous. This membrane satisfies the three above-mentioned criteria and in addition is capable of being lengthened in all directions so as to enable it to keep up with deformation of the knit while the covering is being applied against the shaped panel that is to be covered, and to do so without any constraint.

The above-specified structure for the knit with its polyvinyl chloride threads and a membrane based on microporous polyurethane is particularly adapted to making a covering that is to comply with fire standards, of the kind imposed on coverings for use on panels in commercial aircraft (aviation standard FAR 25).

The membrane is deposited on the knit by the transfer technique which makes use of transfer paper onto which the membrane is initially deposited, being coated in an adhesive on its outside face which is not in contact with the transfer paper. For a polyurethane-based membrane, the adhesive is itself a polyurethane type adhesive. The membrane is applied to the knit by feeding the assembly comprising the transfer paper, the membrane, and the adhesive to a heater cylinder, while the knit is fed between said assembly and the heater cylinder. The temperature implemented in the heater cylinder is about 100° C., thereby activating the adhesive and sticking it together with the membrane onto the face of the knit, thereby releasing the transfer paper. This transfer technique using adhesive is particularly preferred when the knit is made of polyvinyl chloride type fibers. Naturally, other fixing techniques could be used between the membrane and the knit, for example the direct coating technique.

It is clear that the presence of the membrane which extends over the entire outside surface of the knit constitutes a total screen against stains or dirt which is prevented from penetrating into the stitches of the knit. This version of the invention thus provides best ease of cleaning for the covering.

However, the presence of the membrane, light as it may be, nevertheless attenuates the acoustic transparency of the covering, and such transparency may be desired.

That is why in a second embodiment of the invention, it is no longer a continuous membrane which is applied to the outside face of the knit, but instead each component thread of the knit is individually coated in a transparent coating that is lightweight and made of an anti-adhesive material. In other words each thread is, so to speak, individually sheathed by coating or by extrusion, and the sheath may be of the polyvinyl chloride type, for example.

This particular structure makes it possible to preserve the textile-like appearance and the special relief of the knit. Acoustic transparency is indeed improved insofar as the sheath on each thread does not close up the gaps between the stitches of the knit. However, this can make it easier for dirt to penetrate into the structure of the knit, thereby making it less easy to clean.

Whether the coating is in the form of a membrane or in the form of sheathing on the individual threads of the knit, it is possible to improve the desired characteristics by including other additives in the anti-adhesive material that constitutes the coating on the outside face of the knit, for example flame retarders to improve resistance to fire, fluorine-containing additives to make cleaning easier, anti-UV additives to provide better resistance to light.

It should be observed that the membrane is generally impermeable to liquids and that because of its microporosity it is simultaneously permeable to air. Under such conditions, the covering can be thought of as breathing while remaining impermeable. This property can make the covering of the invention suitable for use in other applications.

What is claimed is:

1. A covering for covering shaped panels, the covering being characterized in that it constituted by a knit obtained from a four-bar Raschel or warp loom having two ground threads feeding the first guide needle (I) (Raschel notation) and two appearance threads feeding the second and third guide needles (II and III) in the following arrangement:

| I | II | II |
|---|---|---|
| x | x | x |
| 0 | x | x |
| — | — | — |
| x | x | x |
| x | 2x | 2x |
| — | — | — |

-continued

| I | II | II |
|---|---|---|
| x | x | x |
| 2x | x | x |
| — | — | — |
| x | x | x |
| x | 0 | 0 |
| — | — | — |

and in that the outside face of the knit includes a transparent covering of anti-adhesive material.

2. A covering according to claim 1, characterized in that the value x in the arrangement of the Raschel or warp loom is two (Raschel notation).

3. A covering according to claim 1 characterized in that the knit obtained on the Raschel or warp loom has a gauge of about 12.

4. A covering according to claim 1, characterized in that the outside face of the knit is coated in a membrane that is lightweight, transparent, and highly deformable, being made out of an anti-adhesive material.

5. A covering according to claim 4, characterized in that the membrane is a microporous membrane based on polyurethane and applied by transfer and stuck to the surface of the knit by an adhesive that is also based on polyurethane.

6. A covering according to claim 1, characterized in that each thread constituting the knit is sheathed in a transparent outer coating of anti-adhesive material.

* * * * *